US006564971B2

(12) United States Patent
Heyes

(10) Patent No.: US 6,564,971 B2
(45) **Date of Patent: *May 20, 2003**

(54) BEVERAGE DISPENSER

(75) Inventor: Keith Heyes, Barnt Green (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/934,130

(22) Filed: Aug. 21, 2001

(65) Prior Publication Data

US 2002/0074348 A1 Jun. 20, 2002

Related U.S. Application Data

(63) Continuation-in-part of application No. 09/565,428, filed on May 5, 2000.

(51) Int. Cl.[7] ..... B67D 5/56

(52) U.S. Cl. ..... 222/129.1; 222/145.5; 222/504

(58) Field of Search ..... 222/129.1, 129.2, 222/129.3, 129.4, 145.5, 504

(56) References Cited

U.S. PATENT DOCUMENTS

| | | | | | |
|---|---|---|---|---|---|
| 2,371,432 | A | * | 3/1945 | Di Pietro | 225/26 |
| 2,748,982 | A | * | 6/1956 | Copping | 222/108 |
| 3,653,548 | A | * | 4/1972 | Kotscha et al. | 222/129.1 |
| 3,790,028 | A | * | 2/1974 | Gardner, Jr. et al. | 222/129.4 |
| 3,955,794 | A | * | 5/1976 | Hankosky | 251/123 |
| 4,684,039 | A | * | 8/1987 | Wasserstrom et al. | 222/129.1 |
| 4,726,493 | A | * | 2/1988 | Wallace et al. | 222/129.1 |
| 4,779,761 | A | * | 10/1988 | Rudick et al. | 222/1 |
| 4,815,634 | A | * | 3/1989 | Nowicki | 222/133 |
| 4,863,068 | A | * | 9/1989 | Smith | 222/129.1 |
| 5,038,976 | A | * | 8/1991 | McMillin | 222/129.1 |
| 5,056,686 | A | * | 10/1991 | Jarrett | 222/129.2 |
| 5,167,495 | A | * | 12/1992 | Lebret | 417/490 |
| 5,381,926 | A | * | 1/1995 | Credle, Jr. et al. | 222/1 |
| 5,499,741 | A | * | 3/1996 | Scott et al. | 222/95 |
| 5,601,210 | A | * | 2/1997 | Kelly et al. | 222/129.1 |
| 6,193,109 | B1 | * | 2/2001 | Credle, Jr. et al. | 222/129.4 |
| 6,286,549 | B1 | * | 9/2001 | Carse et al. | 137/607 |
| 6,450,369 | B1 | * | 9/2002 | Heyes | 222/129.1 |

* cited by examiner

*Primary Examiner*—Ehud Gartenberg
*Assistant Examiner*—Frederick C Nicolas
(74) *Attorney, Agent, or Firm*—Stein Erik Hakanson

(57) ABSTRACT

A mixing valve is shown for mixing a concentrate fluid with a diluent fluid in a desired ratio. A single actuator is used to open and close both the diluent and concentrate flows by operation of a shaft. A diaphragm extends around the shaft and defines fluidly separate upper and lower chambers within a valve body. Inlets to the upper and lower chambers are connected to sources of the concentrate and diluent, respectively. The upper and lower chambers each have outlets fluidly connected to a mixing and dispensing nozzle. The actuator moves the shaft from a fully extended closed position to an intermediate t retracted open position to open the lower chamber outlet to the mixing nozzle to initiate diluent flow. The actuator is then moved to a fully retracted position and then reciprocated between the fully retracted and intermediate retracted position whereby the diaphragm serves to pump the concentrate from the upper chamber to the mixing nozzle. Non-return valves are placed in the inlet and outlet of the upper chamber. The non-return valves allow the concentrate to flow only from the source thereof to the mixing nozzle during the pumping thereof. Flow sensors are placed in each of the concentrate and diluent flows and are connected to an electronic control. The control provides for determining total combined dispensed volume of the diluent and concentrate and stopping dispensing at desired predetermined total volumes.

4 Claims, 4 Drawing Sheets

BEVERAGE DISPENSER

This application is a continuation-in-part of application Ser. No. 09/565,428 filed on May 5, 2000.

This invention relates to a valve. The valve is particularly intended for use in the dispensing of beverages that are mixed at the point of sale from a concentrate and a diluent and although not limited to such use, it will for convenience be described further below with specific reference to the dispensing of such beverages.

Beverages that are mixed at the point of sale require accurate metering of the concentrate, e.g. syrup, and the diluent, which is usually plain or carbonated water. It is, therefore, an object of the present invention to provide a valve, and a beverage dispenser incorporating the valve, through which desired ratios can be accurately and reliably metered at an economic cost.

Accordingly in one aspect the invention provides a valve comprising a housing having an inlet and an outlet for a first fluid and an inlet and an outlet for a second fluid, a reciprocatable piston in a central chamber into and from which the inlets and outlets respectively lead, the piston being movable reciprocably between a first position in which fluid flow to both outlets is blocked and a second position in which the first fluid outlet is open to flow, the piston physically blocking the outlet for the first fluid in the first position, a diaphragm attached to the piston and to the walls of the central chamber dividing the central chamber into first and second annular chambers surrounding the piston, the inlet and outlet for the first fluid being into and out of the first chamber and the inlet and outlet for the second fluid being into and out of the second chamber, movement of the piston from the first to the second position allowing flow of the first fluid through its outlet and causing movement of the diaphragm with the piston to reduce the volume of the second chamber to expel second fluid through its outlet and movement of the piston from the second position to a position intermediate the first and second positions causing an increase in volume of the second chamber whereby second fluid maybe sucked from a source thereof through its inlet into the second chamber.

It will be appreciated that the piston may then be reciprocated repeatedly between the second and intermediate positions to repeatedly reduce and increase the volume of the second chamber whereby second fluid may be pulsed through its outlet while the first fluid continues to flow. When sufficient fluids have been allowed to flow, e.g. to complete a beverage dispense, the piston is moved back to the first position and flow of both fluids stops.

In another aspect the invention provides a beverage dispenser comprising a valve of the invention, one inlet of which is connectable to a source of diluent, usually plain or carbonated water, and the other inlet of which is connectable to a source of concentrate, and a mixing nozzle into which both outlets of the valve lead and from which the mixed beverage is dispensed.

The inlet to the second chamber of the valve may contain a non-return suction valve openable into the second chamber when second fluid pressure in that chamber is reduced by the piston moving from the second to the intermediate position. Second fluid, e.g. a beverage concentrate, is then sucked into the second chamber and is then expelled from the second chamber through its outlet when the piston returns to the second position.

The outlet to the second chamber of the valve preferably contains a non-return valve that opens the outlet when a predetermined minimum pressure level of fluid in the second chamber is reached. Thus this non-return valve may be spring-assisted to provide the required minimum back pressure against flow or it maybe of a flexible construction designed to open when the required chamber pressure is reached.

It will be appreciated that when the piston has been moved from the first, closed position, the outlet for the first fluid, e.g. beverage diluent, remains fully open while the piston is reciprocated between the second and intermediate positions. The diluent, therefore, in a beverage dispense, has a nominal flow rate and a flow sensor may be provided in the concentrate flow line to match the required flow of concentrate to the flow of diluent. Preferably, a flow sensor may be provided in both flow lines, the sensor being connected to a pre-programmed controller to cut off flow when the required volumes have been dispensed.

The diluent flow into the first chamber may provide a pressure of, for example, 6 to 8 bar on its side of the diaphragm when the valve is closed. This pressure, therefore, provides assistance to the initial movement of the piston when the valve is opened and the piston moved from the first towards the second position. Similarly, the above-described back pressure provided by the second chamber outlet non-return valve reduces the pressure on the diaphragm during movement of the piston from the second towards the intermediate position.

By way of example only, for a typical syrup/diluent mixture for a beverage, the pumping frequency from the second chamber, i.e. the frequency of moving the piston from the second position to the intermediate position and back again may be from 5 to 15 pulses per minute, e.g. 10 per minute.

The means to move the piston is preferably controlled by the controller on receiving a dispense signal, e.g. the pressing of a button for a particular beverage. The controller will then open the valve by instructing a suitable actuator to move the piston to the second position and to reciprocate the piston between the second and intermediate positions for the time appropriate for the required flow for the size of beverage to be dispensed.

The actuator may conveniently be a stepper motor, e.g. of the pulsed, magnetically driven type, or a proportional solenoid actuator but other actuators, e.g. a lever mechanism or a diaphragm operated mechanism may be used if desired.

It will be appreciated that whatever actuator mechanism is used to move the piston, it must be designed to operate between the three basic piston positions, i.e. it must be able to move the piston to the first, valve closed position and to the second, valve open position and to reciprocate the piston between the second position and the intermediate position in which the first fluid outlet remains open.

The second fluid outlet may be provided with plenum means to even the pulsed flow from the second chamber outlet. Thus flow of concentrate, or other second fluid, into a discharge or mixing nozzle may be smoothed to improve mixing with the first fluid (diluent). This may be achieved by a variety of means. For example, the outlet may pass through or comprise a flexible chamber, which may be a spring-assisted diaphragm.

Where the second fluid is a concentrate, it may be supplied to the second chamber of the valve from a source of concentrate, e.g. a flexible bag positioned above the second fluid inlet. The concentrate from the bag cannot flow through the second chamber outlet except during pulsing of the diaphragm because of the back pressure applied at the non-return valve in the outlet. Thus, this arrangement prevents dripping of concentrate from the outlet when dispense is not required and the valve is closed.

Embodiments of the invention will now be described by way of example only with reference to the accompanying drawings in which.

Figure 1:
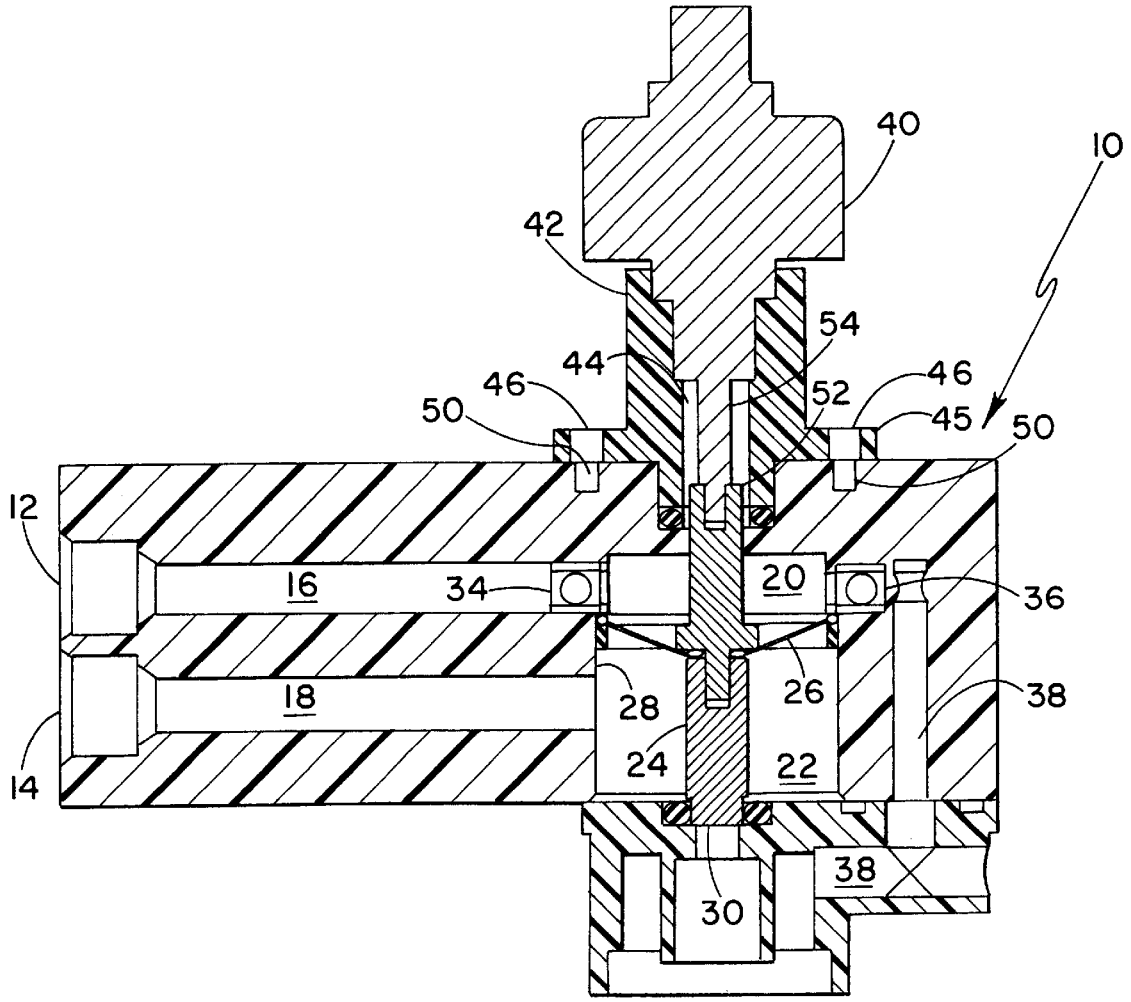
FIG. 1 is a section through a valve of the invention with the piston in the first, i.e. valve closed, position.

In the drawings a valve 10 has an inlet 12 for a concentrated syrup and an inlet 14 for a diluent usually plain or carbonated water. Both inlets 12 and 14 lead via passageways 16, 18 respectively to a central chamber in the valve, the central chamber comprising an upper (second) chamber 20 into which passageway 16 leads and a lower (first) chamber 22 into which passageway 18 leads.

A piston 24 is reciprocatably movable in the central chamber along an axis substantially perpendicular to the direction of passageways 16 and 18. A diaphragm 26 is attached to piston 24 and to the walls 28 of the central chamber thereby dividing the central chamber into the upper and lower chambers 20, 22.

In FIG. 1, piston 24 is shown lowered to the first position, i.e. the valve closed position. It blocks an outlet 30 from chamber 22.

Outlet 30 leads to a mixing nozzle 32 (shown in FIG. 3) where diluent and syrup can mix when both flow through the valve.

Inlet 14 for diluent leads directly through passageway 18 into chamber 22 so that diluent flows continuously into the chamber 22 when diluent flow is required, i.e. on signalling the start of a dispense, and the outlet 30 is open.

Inlet 12 for concentrate, however, leads via passageway 16 to a one-way suction valve 34 through which the concentrate must pass in order to enter chamber 20. In the valve closed position of FIG. 1, concentrate cannot pass through valve 34.

A non-return valve 36 connects chamber 20 to a concentrate outlet passage 38, which also leads into mixing nozzle 32.

Piston 24 is connected at its upper end to an actuator 40, which may be, for example, a stepper motor. When dispense of a beverage is required a signal from a controller causes the actuator 40 to lift the piston through the position shown in FIG. 2 to the position shown in FIG. 3 and then repeatedly lower and raise it between the positions shown in FIGS. 2 and 3 until a full dispense has been made, whereupon the piston is lowered to the closed position of FIG. 1.

Actuator 40 is mounted on the top of the valve 10 by means of an annular housing 42 containing a stepped bore 44 through which the actuator operates. Housing 42 has a lower annular flange 45 having bolt holes 46 by means of which the housing can be attached to the upper surface of the valve 10 using its corresponding bolt holes 50.

The upper end of piston 24 is attached to a connecting rod 52, which in turn is connected at its upper end to an extendable actuator rod 54, rods 52 and 54 being slidable in bore 44. The extension and retraction of rod 54 from the actuator enables the piston to be reciprocated, as desired.

Figure 3:
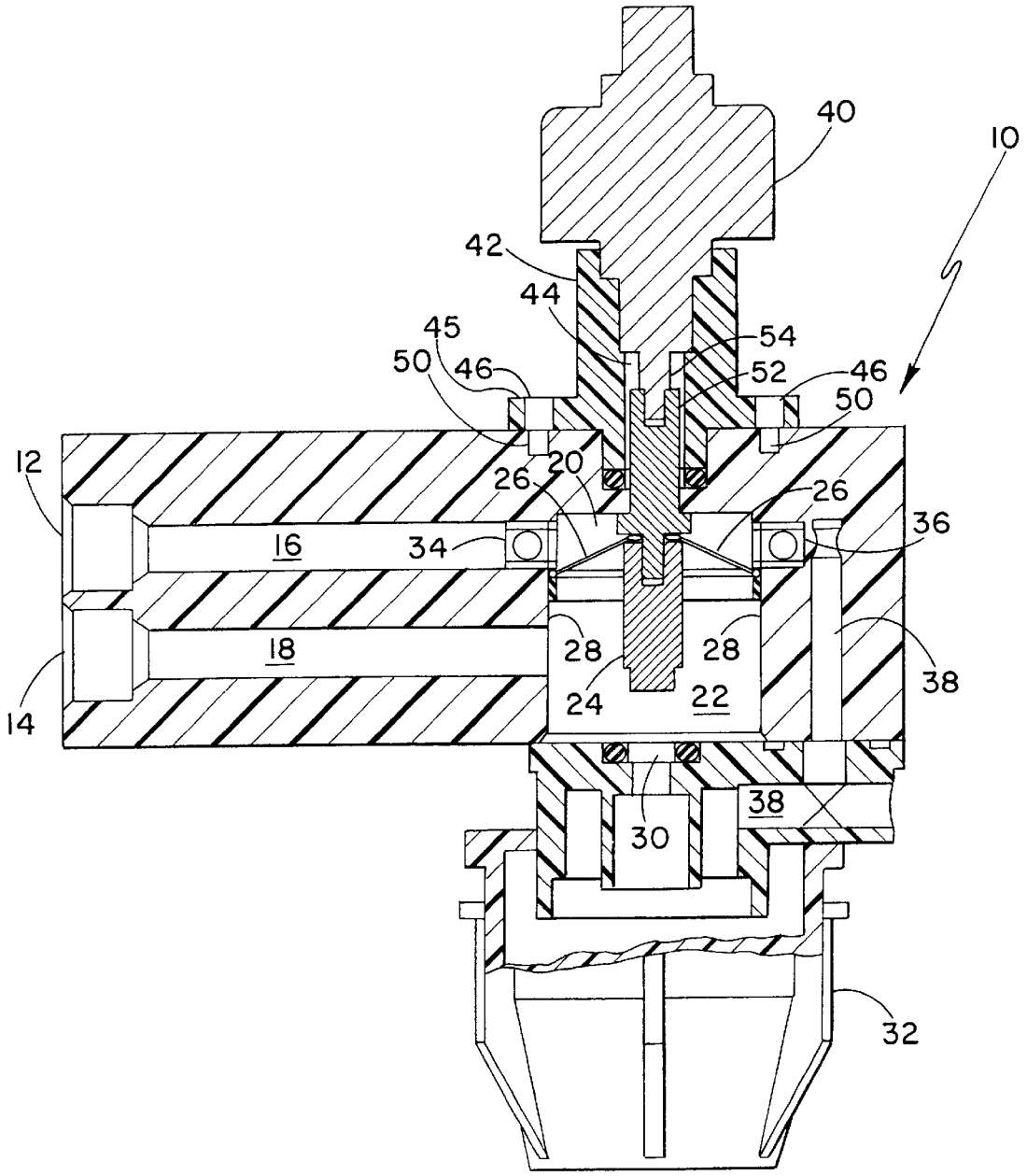
FIG. 3 is a similar section through the valve of FIG. 1 with the piston in the second, i.e. open, position.
Figure 4:
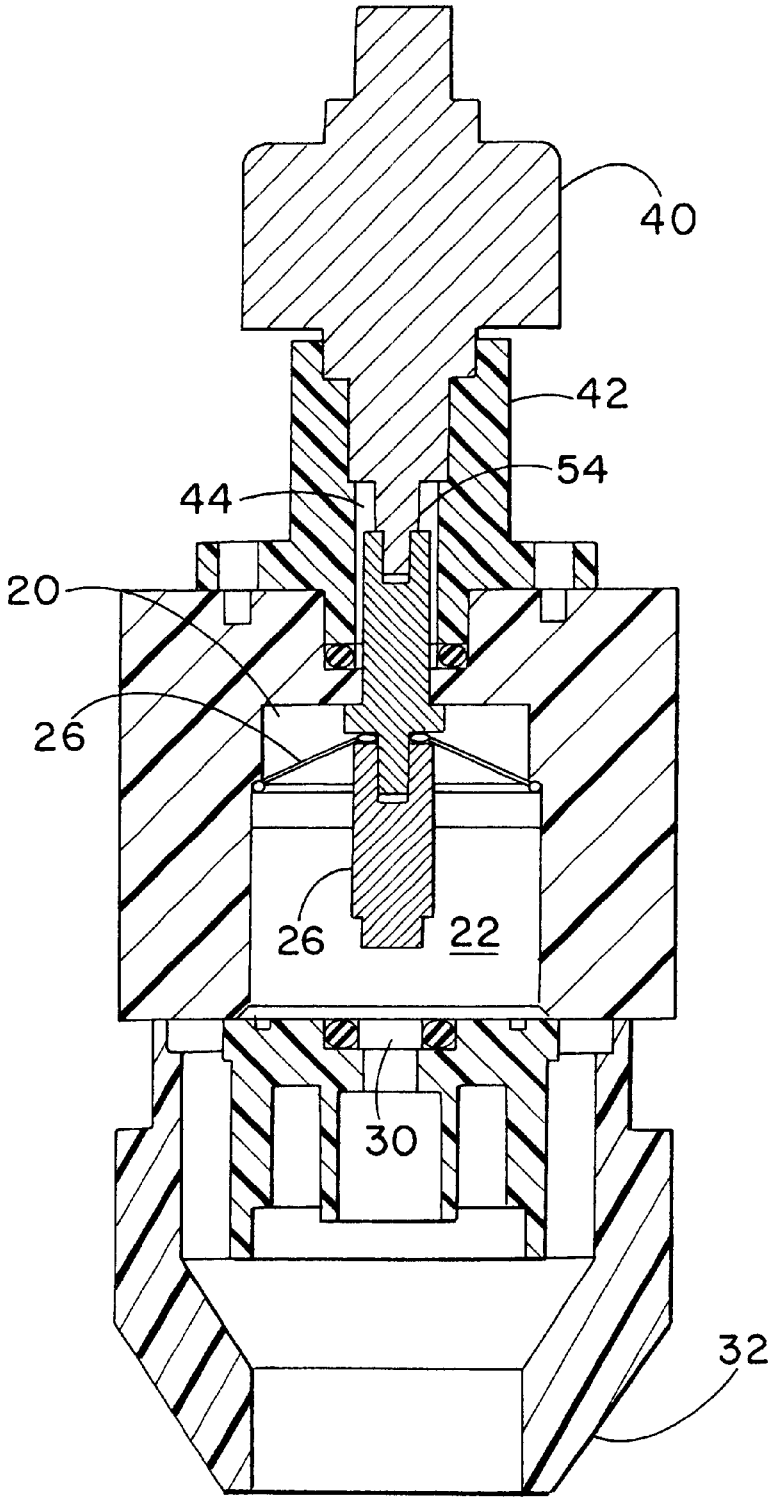
FIG. 4 is a section at right angles to the section of FIG. 3.

In the position shown in FIG. 3 some of the concentrate filling chamber 20 is expelled through non-return valve 36 because of the reduction in volume of the chamber caused by the raising of the diaphragm 26 due to its attachment to the raised piston. Such expelled concentrate flows through passageway 38 to mix in nozzle 32 with diluent which is flowing freely through outlet 30, the latter having been opened by the raising of the piston.

Figure 2:
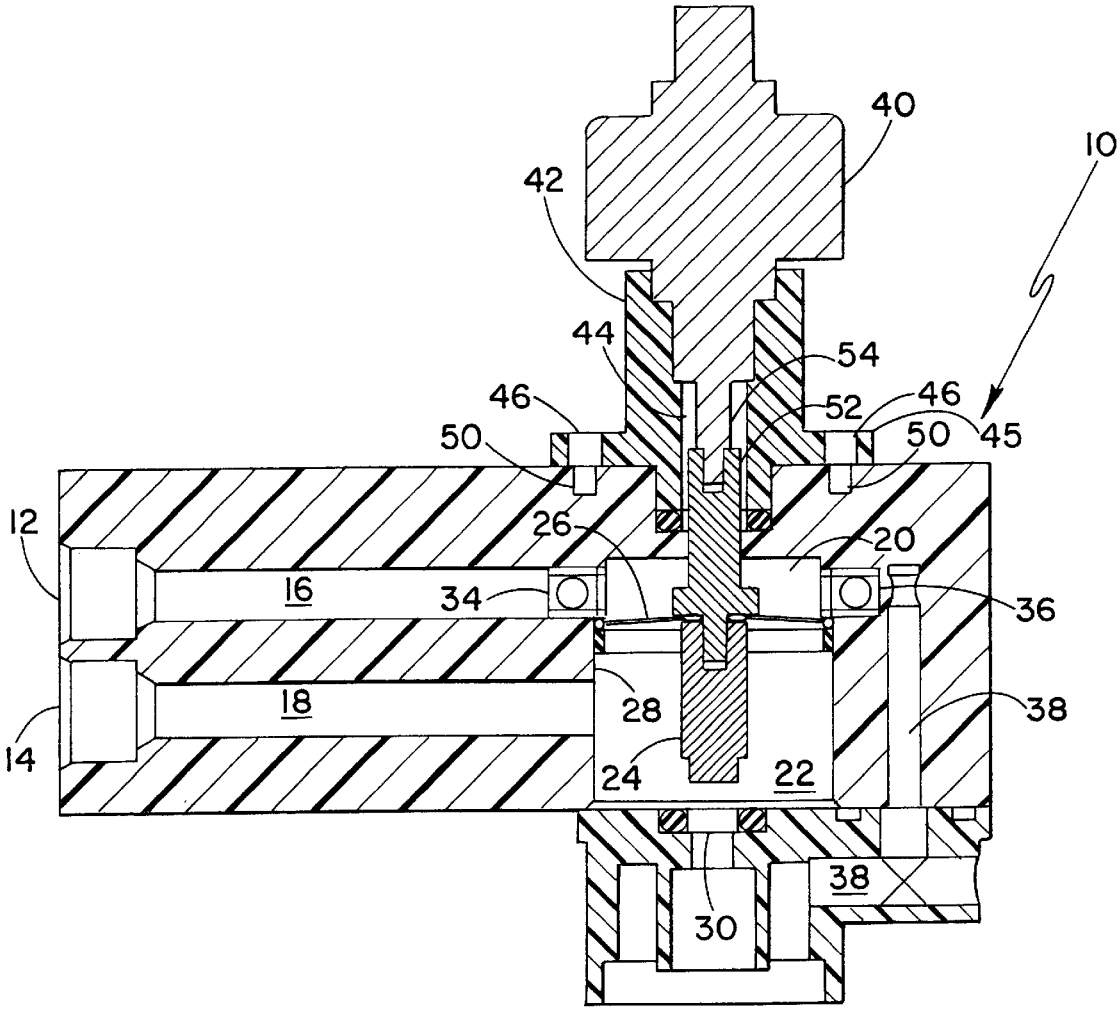
FIG. 2 is a similar section through the valve of FIG. 1 with the piston in the intermediate valve position.

Movement of the piston and diaphragm from their position shown in FIG. 3 to the intermediate position of FIG. 2 causes an increase in volume of chamber 20, thereby sucking concentrate from a source (not shown) through inlet 12, passageway 16 and valve 34 into chamber 20. Upward movement of the piston back to the FIG. 3 position causes more diluent to be expelled through valve 36. This reciprocating movement continues to pulse concentrate to the mixing nozzle until a full dispense has been achieved and the valve is closed by returning the piston to the first position of FIG. 1. Diluent continues to flow during this reciprocating action of the piston as outlet 30 remains open until the piston is finally returned to the first position.

What is claimed is:

1. A valve for dispensing a concentrate liquid and a diluent liquid at a desired ratio there between, comprising:

a valve body having an internal cavity, a linear actuator for moving a shaft, the shaft extending through the internal cavity and the shaft having a diaphragm extending there around and the diaphragm having a perimeter fluid tightly secured with an inner wall surface of the internal cavity for dividing the internal cavity into fluidly separate upper and lower chambers, and the upper and lower chambers each having inlets for connection to sources of the concentrate and diluent respectively, and the upper and lower chambers each having outlets for providing fluid connection to a dispensing nozzle, and the linear actuator for positioning the shaft in a fully extended position so that an end of the shaft obstructs the lower chamber outlet for preventing flow of the diluent to the dispensing nozzle and for positioning the shaft to an intermediate non-obstructing retracted position for permitting flow of the diluent to the mixing nozzle, and the linear actuator for moving the shaft to a fully retracted position and for reciprocating the shaft between the intermediate and fully retracted positions whereby movement of the diaphragm provides for a pumping action for moving the concentrate to the mixing nozzle.

2. The dispensing valve as defined in claim 1, and the inlet and outlet of the upper chamber including non-return valves so that during the pumping of the concentrate the concentrate can only flow in the direction from the source thereof to the mixing nozzle.

3. The dispensing valve as defined in claim 1, and further including two flow sensors in the valve body and one each individually in fluid contact with the concentrate and diluent for sensing the flow rate thereof and the flow sensors connected to a control for determining the total combined volume flow of the diluent and concentrate for stopping the flows thereof when a predetermined total volume has been dispensed from the dispensing nozzle.

4. The dispensing valve as defined in claim 3, further including two flow sensors in the valve body and one each individually in fluid contact with the concentrate and diluent for sensing the flow rates thereof and the flow sensors connected to a control for determining the total combined volume flow of the diluent and concentrate for stopping the flows thereof when a predetermined total volume has been dispensed from the dispensing nozzle.

* * * * *